US007784528B2

(12) United States Patent
Ottow et al.

(10) Patent No.: US 7,784,528 B2
(45) Date of Patent: Aug. 31, 2010

(54) HEAT EXCHANGER SYSTEM HAVING MANIFOLDS STRUCTURALLY INTEGRATED WITH A DUCT

(75) Inventors: Nathan Wesley Ottow, Middletown, OH (US); Scott Richard Zearbaugh, Milford, OH (US); Phillip Michael Lariviere, Loveland, OH (US)

(73) Assignee: General Electric Company, Schenectady, NY (US)

( * ) Notice: Subject to any disclaimer, the term of this patent is extended or adjusted under 35 U.S.C. 154(b) by 145 days.

(21) Appl. No.: 11/616,587

(22) Filed: Dec. 27, 2006

(65) Prior Publication Data

US 2008/0156473 A1 Jul. 3, 2008

(51) Int. Cl.
*F28D 7/10* (2006.01)

(52) U.S. Cl. ..... 165/169; 165/158

(58) Field of Classification Search ..... 165/157, 165/158, 169, DIG. 348, DIG. 349, DIG. 350, 165/DIG. 422
See application file for complete search history.

(56) References Cited

U.S. PATENT DOCUMENTS 1,500,838 A * 7/1924 Miiller ..... 165/103
2,433,655 A * 12/1947 Di Zoppola ..... 165/74
3,054,257 A 9/1962 Schelp
5,317,877 A 6/1994 Stuart
5,848,636 A * 12/1998 Chuang ..... 165/74
6,422,020 B1 7/2002 Rice

FOREIGN PATENT DOCUMENTS

DE 3320012 A1 12/1984
EP 1215460 A2 6/2002
FR 1489838 A 7/1967

* cited by examiner

*Primary Examiner*—Teresa J Walberg
(74) *Attorney, Agent, or Firm*—McNees Wallace & Nurick, LLC

(57) ABSTRACT

A heat exchanger system includes a duct having a duct wall with a duct wall outer surface and a duct wall inner surface; and a heat exchanger partial shell hermetically joined to the duct wall inner surface. The heat exchanger partial shell and a shell portion of the duct wall inner surface constitute a heat exchanger. A heat exchanger inlet manifold is defined by a nonplanar inlet sheet of material hermetically joined to the duct wall outer surface. A heat exchanger outlet manifold is defined by a nonplanar outlet sheet of material hermetically joined to the duct wall outer surface. A heat exchanger inlet opening extends through the duct wall between the inlet manifold and the heat exchanger, and a heat exchanger outlet opening extends through the duct wall between the outlet manifold and the heat exchanger.

21 Claims, 5 Drawing Sheets

HEAT EXCHANGER SYSTEM HAVING MANIFOLDS STRUCTURALLY INTEGRATED WITH A DUCT

This invention relates to a heat exchanger system that uses a fluid flowing in a duct to heat or cool a fluid that flows through inlet and outlet manifolds, and more particularly to such a heat exchanger system wherein the inlet manifold, the outlet manifold, and the heat exchanger are integral with a wall of the duct.

BACKGROUND OF THE INVENTION

In an aircraft design, a continuous flow of hot air is bled from one part of a gas turbine engine, cooled, and provided to a specific user application. A heat exchanger system may be used to cool the hot bleed air.

The preferred medium for cooling hot bleed air is engine bypass air that flows through the gas turbine fan duct. There are several limitations on the design of the heat exchanger system that exchanges heat between the bleed air and the bypass air. The inlet manifold that brings the hot bleed air to the heat exchanger, the heat exchanger itself, and the outlet manifold that transports the cooled bleed air away from the heat exchanger cannot together impose too great a pressure drop, or the cooled bleed air that reaches the user application will have insufficient pressure to perform properly. Weight and size also impose tight limitations. As with all aircraft structures, it is important to keep the weight of heat exchanger system as low as possible. The heat exchanger system also cannot significantly increase the envelope size of the gas turbine engine, and desirably is as small as possible to leave installation space for other aircraft systems.

Dimensional changes are potentially a concern in the heat exchanger. The dimensional changes result from two sources. The components of the engine change size due to the mechanical loadings that occur as the gas turbine engine is powered. The components of the engine also change size as their temperatures vary during use. These dimensional changes must be accounted for in the heat exchanger structure, or otherwise the resulting stresses and strains would lead to premature failure of the heat exchanger unit. The thermally induced stresses and strains are particularly a concern for the heat exchanger system, where gases of different temperatures are in close proximity, and the relative temperature of the gases changes over time.

There is a need for a compact, lightweight heat exchanger system that cools the flow of hot bleed air.

SUMMARY OF THE INVENTION

The present invention fulfills the need to cool bleed air and further provides related advantages.

The present invention provides a heat exchanger system that exchanges heat from a hot gas to a cool gas flowing in a gas turbine engine bypass duct. The heat exchanger system mounts directly to the wall of the duct, and the heat exchanger and manifold are integral with the duct. That is, the duct wall forms a portion of the walls of the manifolds and of the heat exchanger, thereby saving a substantial amount of weight. The heat exchanger system has a low pressure drop therethrough, and is compact in size. This type of heat exchanger system may find application for other types of heat exchanger requirements, both in aircraft and otherwise.

In accordance with the invention, a heat exchanger system comprises a duct having a duct wall with a duct wall outer surface and a duct wall inner surface. A heat exchanger partial shell is joined to the duct wall inner surface, so that the heat exchanger partial shell and a shell portion of the duct wall inner surface constitute a heat exchanger. A heat exchanger inlet manifold is positioned at an inlet location along the duct wall and comprises an elongated nonplanar inlet sheet of material defining a portion of the inlet manifold. The inlet sheet of material is joined to the duct wall outer surface, so that the elongated nonplanar inlet sheet and an inlet-manifold portion of the duct wall outer surface define the inlet manifold. A heat exchanger inlet opening extends through the duct wall between the inlet manifold and the heat exchanger. A heat exchanger outlet manifold is positioned at an outlet location along the duct wall and comprises an elongated nonplanar outlet sheet of material defining a portion of the outlet manifold. The outlet sheet of material is joined to the duct wall outer surface, so that the elongated nonplanar outlet sheet and an outlet-manifold portion of the duct wall outer surface define the outlet manifold. A heat exchanger outlet opening extends through the duct wall between the outlet manifold and the heat exchanger.

In one form, the nonplanar inlet sheet of material has two inlet-manifold side margins, and each inlet-manifold side margin is joined to the duct wall outer surface. The nonplanar outlet sheet of material has two outlet-manifold side margins, and each outlet-manifold side margin is joined to the duct wall outer surface. In another form, the nonplanar inlet sheet of material and the nonplanar outlet sheet of material are the same sheet of material.

In the preferred application, the duct is a fluid flow duct, and most preferably a gas flow duct, such as an air bypass duct in a gas turbine engine. The duct is substantially cylindrical in shape at each location along its length. The duct has a fluid-flow direction therethrough, and a direction of elongation of the inlet manifold that is perpendicular to the fluid-flow direction. A direction of elongation of the outlet manifold is also perpendicular to the fluid-flow direction. These perpendicularities are preferred for the present application, but other configurations are operable.

In the preferred application, the inlet sheet of material is made of a metal, and the inlet sheet of material is welded to the duct wall outer surface. The outlet sheet of material is made of a metal, and the outlet sheet of material is welded to the duct wall outer surface. The heat exchanger partial shell is made of a metal, and is bolted to the duct wall inner surface. However, other materials and joining techniques maybe used for these various components.

The components may be made of metal of any operable type, with titanium-base alloys, nickel-base alloys, cobalt-base alloys, aluminum-base alloys, magnesium-base alloys, and metallic composite materials being examples. The components may be nonmetallic, with polymers, nonmetallic composite materials such as fiberglass and carbon/epoxy composites, and ceramics being examples. Where appropriate, welding may be used, but other joining techniques such as bolting, screwing, other types of mechanical fasteners, riveting, brazing, adhesives, and integral lay-up may be employed. The components may be made of the same material or different materials.

The manifolds may either be affixed to the duct wall outer surface, or may be integrated into the outer portion of the duct wall, but in either case are integral with the duct wall. In the former case, the inlet-manifold side margin is at a side margin of the nonplanar inlet sheet of material, and the outlet-manifold side margin is at a side margin of the nonplanar outlet sheet of material. In the latter case, the nonplanar inlet sheet of material extends beyond the inlet-manifold side margin, and the nonplanar outlet sheet of material extends beyond the outlet-manifold side margin.

The heat exchanger partial shell is preferably joined to the duct wall inner surface with a plurality of mechanical fasteners such as bolts. There is normally an internal baffle within the heat exchanger partial shell.

More generally, a heat exchanger system comprises a duct having a duct wall with a duct wall outer surface and a duct wall inner surface, and a heat exchanger partial shell hermetically joined to the duct wall inner surface. The heat exchanger partial shell and a shell portion of the duct wall inner surface together constitute a heat exchanger. A heat exchanger inlet manifold is defined by a nonplanar inlet sheet of material hermetically joined at its inlet-manifold side margins to the duct wall outer surface, and the inlet-manifold portion of the duct wall outer surface. A heat exchanger inlet opening extends through the duct wall between the inlet manifold and the heat exchanger. A heat exchanger outlet manifold is defined by a nonplanar outlet sheet of material hermetically joined at its outlet-manifold side margins to the duct wall outer surface, and the outlet-manifold portion of the duct wall outer surface. A heat exchanger outlet opening extends through the duct wall between the outlet manifold and the heat exchanger. Other compatible features discussed herein may be used with this embodiment.

The present approach provides a number of important advantages over alternative possible design approaches for the heat exchanger system. The pressure drop through the inlet manifold, the heat exchanger, and the outlet manifold is reduced, as compared with alternative approaches. The total component weight is reduced. Part count and complexity of the heat exchanger system are reduced, the amount of tooling and its cost and complexity are reduced, and engine build time is reduced, all of which are significant considerations in manufacturing. The overall manufacturing cost is thereby reduced. Bypass air leakage is eliminated. Part wear is reduced, and maintainability is improved due to the reduction in part wear, the reduction in part count, and the elimination of joint leakage. The size and envelope of the manifolding are reduced as compared with alternative approaches such as piped gas-flow systems for the hot gas. The latter is an important consideration for the modern gas turbine engine, inasmuch as space must be available within the overall engine envelope for a large number of systems of different types, and reducing the size and envelope of each component aids in finding space for the others.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

As used herein, a "fluid" may be a gas or a liquid. The present approach is not limited by the types of fluids that are used. In the preferred application, the cooling fluid is air, and the cooled fluid is air. The present approach may be used for other types of liquid and gaseous fluids, where the cooled fluid and the cooling fluid are the same fluids or different fluids, and may be used either to heat or cool various fluids. Other examples of the cooled fluid and the cooling fluid include hydraulic fluid, fuel, oil, and combustion gas.

Figure 1:
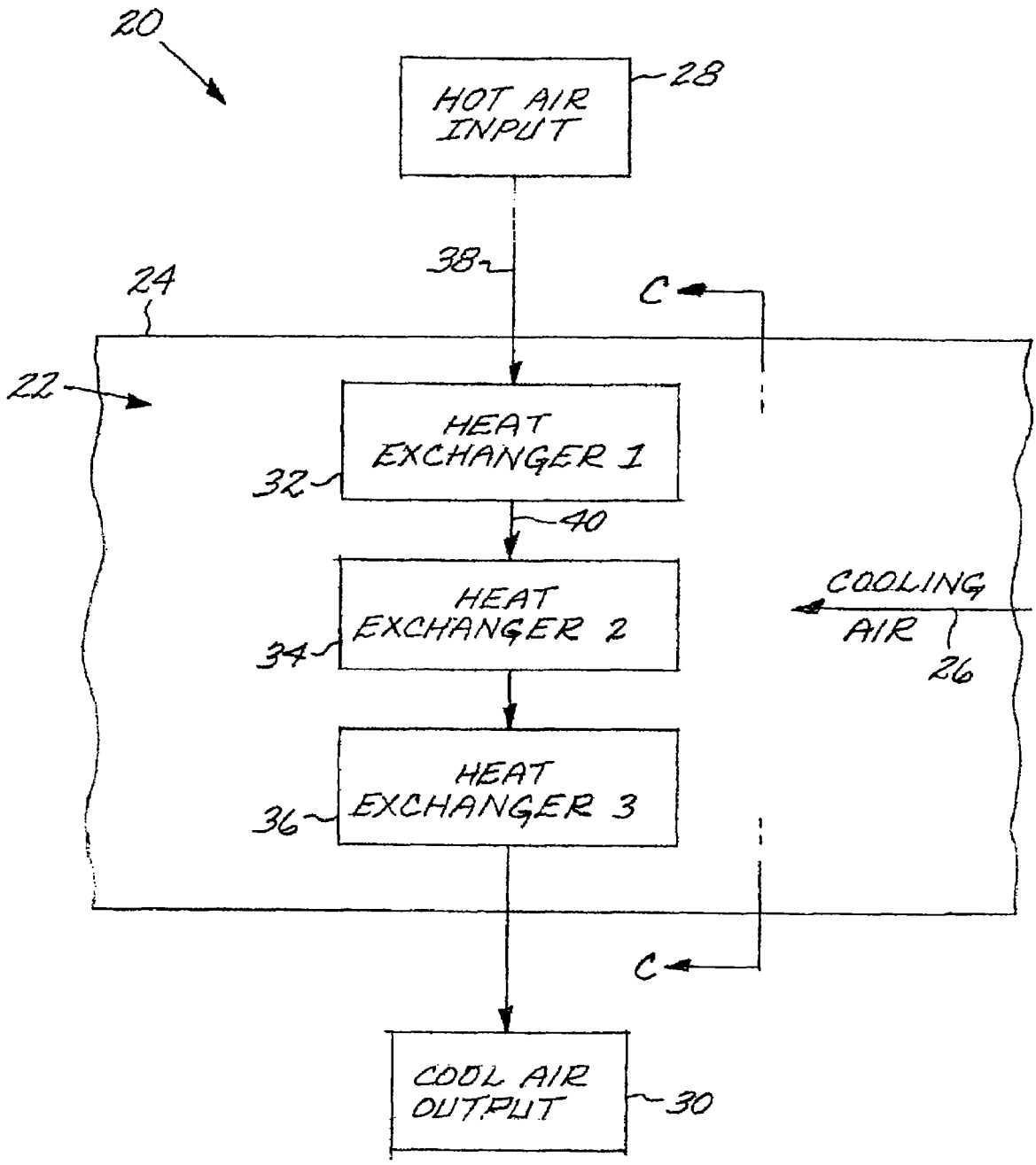
FIG. 1 is a schematic heat exchanger system gas flow diagram, showing sources and dispositions of gases.

FIG. 1 depicts a heat exchanger system 20 of the present type in general terms. A duct 22 has a duct wall 24. The duct wall 24 typically has a generally cylindrical configuration when viewed in cross section C-C. Cooling air 26 flows through the duct 22. In a typical situation of interest, the duct 22 is the fan duct of a gas turbine engine, and the cooling air 26 is bypass air driven through the fan duct by the bypass fan.

Hot air input 28 is typically bled from a portion of the engine core, where it is available at the temperature and pressure of interest. Cool air output 30 is produced by the heat exchanger system 20 by passing the hot air input 28 through one or more heat exchangers, here illustrated as three heat exchangers 32, 34, and 36. (The cool air output 30 resulting from the hot air input 28 is not to be confused with the cooling air 26 that passes through the interior of the duct 22.) As will be illustrated subsequently, the heat exchangers 32, 34, and 36 are preferably located around the circumference of the duct wall 24, not within the central part of the duct 22. Hot air is introduced from the hot air input 28 into the heat exchanger 32 through a heat exchanger inlet manifold 38, and removed from the heat exchanger 32 through a heat exchanger outlet manifold 40. The terms "inlet manifold" and "outlet manifold" are used relative to any one of the heat exchangers. If there is more than one heat exchanger, as illustrated, the outlet manifold for the first heat exchanger 32 serves as the inlet manifold for the second heat exchanger 34, and so on. In each heat exchanger, the hot air passing through the manifolds 38, 40 is further cooled by the cooling air 26. The present approach is compatible with the use of only a single heat exchanger, or multiple heat exchangers.

Figure 2:
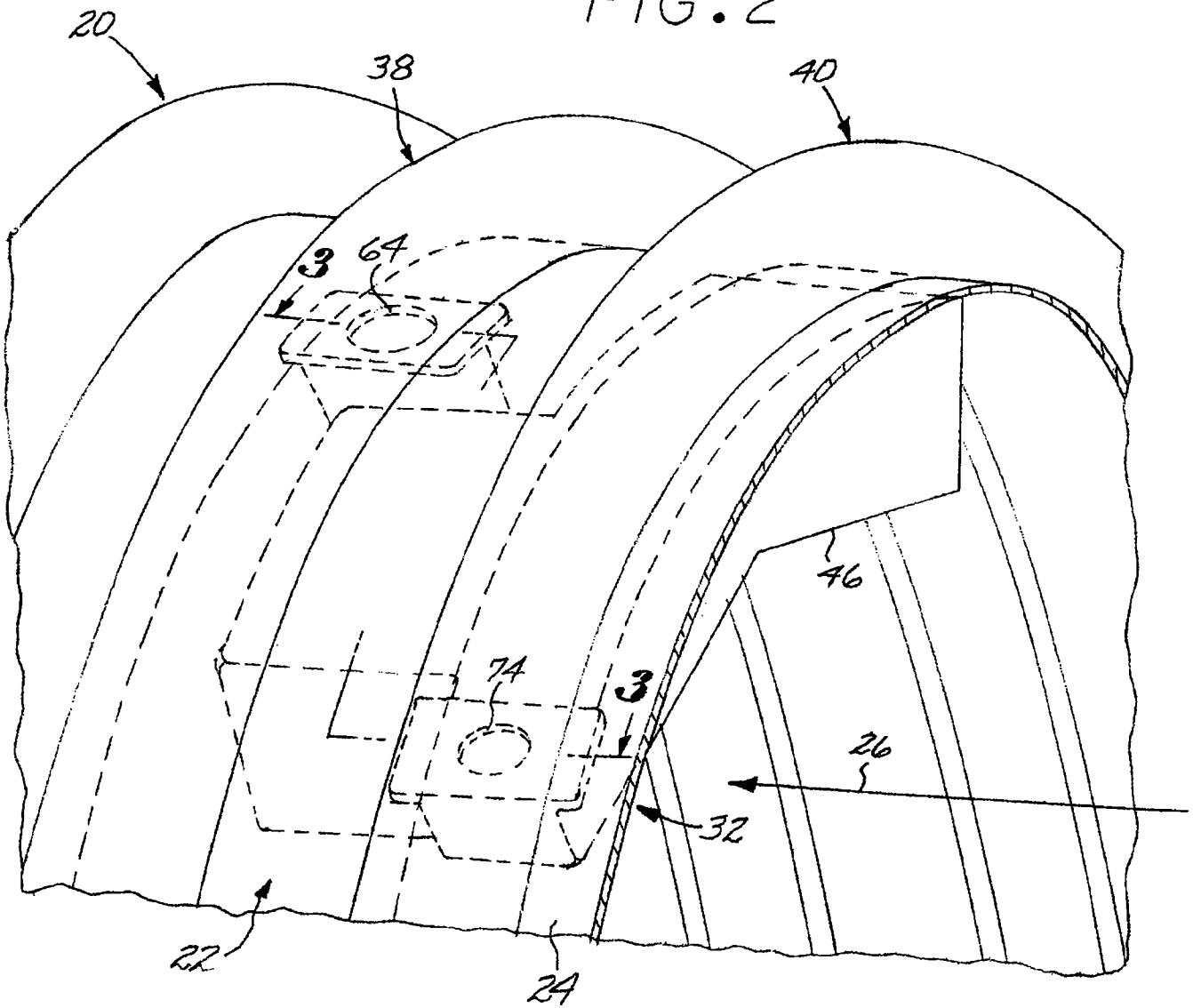
FIG. 2 is a perspective view of the heat exchanger system.
Figure 3:
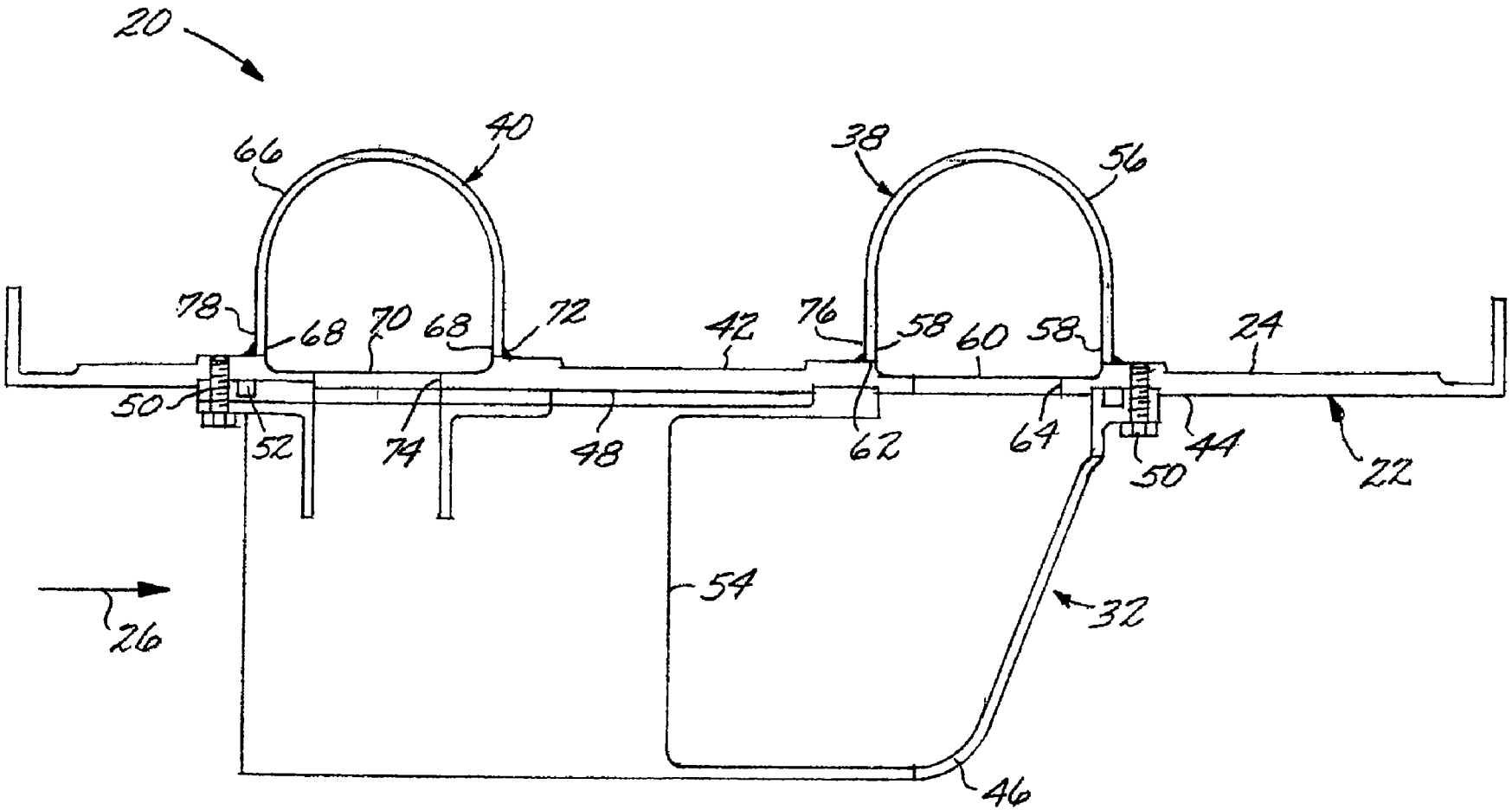
FIG. 3 is a sectional view of the heat exchanger system, taken on lines 3-3 of FIG. 2.
Figure 4:
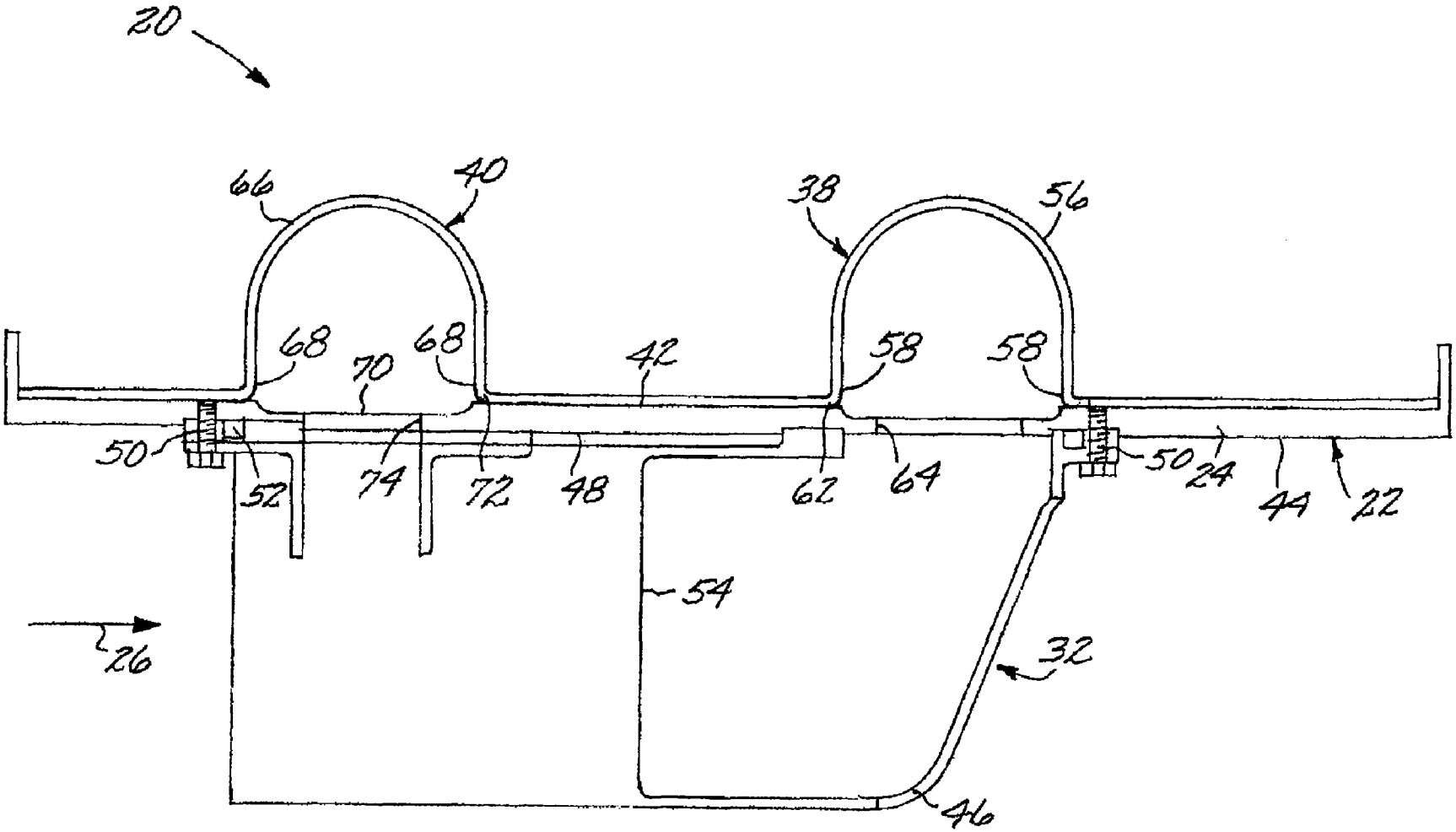
FIG. 4 is a sectional view of another construction of the heat exchanger system, taken on lines 3-3 of FIG. 2.

FIGS. 2-4 depict a preferred embodiment of the heat exchanger system 20 in greater detail, for a single heat exchanger 32 (the others may be substantially identical) and without including the hot air input 28 and the cool air output 30. The generally cylindrical nature of the duct 22 may be seen in FIG. 2. The duct wall 24 has a duct wall outer surface 42 and a duct wall inner surface 44 (FIGS. 3-4). The duct 22 is generally a fluid flow duct, so that a fluid, either a liquid or a gas, flows through the duct 22. In the preferred application, the duct 22 is a gas flow duct through which a gas such as air passes. Most preferably, the duct 22 is a part of a gas turbine engine such as the bypass air duct for a bypass fan. Bypass air flows through the duct 22 and serves as the cooling air 26. In other applications, either the cooling fluid (comparable to the cooling air 24) or the fluid to be cooled (comparable with the hot air 28/cool air 30) may be a liquid.

A heat exchanger partial shell 46 generally has the shape of an irregularly shaped shallow pan having a bottom and sides but no top. The heat exchanger partial shell 46 is joined to the duct wall inner surface 44. A shell portion 48 of the duct wall inner surface 44 thereby provides the top for the pan-like heat exchanger partial shell 46. The heat exchanger partial shell 46 and the shell portion 48 of the duct wall inner surface 44 together constitute the heat exchanger 32. That is, the duct wall 24 serves both as a structural part of the duct 22 and also as the top of the heat exchanger 32, thereby saving weight.

The heat exchanger partial shell 46 is preferably joined to the duct wall inner surface 44 at a boss in the duct wall 24 with a plurality of mechanical fasteners 50, such as bolts or screws. Other operable joining techniques may be used as well. A seal 52 such as an elastomer seal extends around the periphery of the partial shell 46 where it contacts the duct wall inner surface 44 to prevent leakage of fluid into or out of the interior of the heat exchanger 32. The heat exchanger partial shell 46 typically includes one or more internal baffles 54 to cause the fluid to flow therein in an optimal manner for achieving the desired heat transfer.

The heat exchanger inlet manifold 38 is at an inlet location along the duct wall 24. (As used herein, a "location" may include a point or may extend over a spatial range.) The heat exchanger inlet manifold 38 includes an elongated nonplanar inlet sheet 56 of material having two inlet-manifold side margins 58. The elongated nonplanar inlet sheet 56 is typically made of a metal such as a titanium alloy or steel, but may be made of other operable materials such as a nonmetallic composite material. The various inlet manifolds 38 extending between the different heat exchangers 32, 34, and 36 may be made of the same material, but need not be. The air conducted through the different manifolds 38 is progressively cooled, and therefore materials of lower temperature capability (and potentially lighter weight) may be used for the later manifolds.

Each inlet-manifold side margin 58 is joined to the duct wall outer surface 42 by an inlet-manifold side-margin joint 62 that extends the length of each side of the inlet manifold 38. Because the duct wall outer surface 42 is generally planar when viewed in cross section, as in FIGS. 3-4, the inlet manifold 38 is typically noncircular in cross section. The inlet-manifold side-margin joint 62 between the inlet-manifold side margin 58 and the duct wall outer surface 42 is selected to be any operable type that is appropriate for the materials of construction and for the service temperature. In the preferred case where the elongated nonplanar inlet sheet 56 and the duct wall 24 are both metals, the inlet-manifold side-margin joint 62 is preferably a seam weld. In other cases, the inlet-manifold side-margin joint could be a brazed joint or an adhesive joint.

The elongated nonplanar inlet sheet 56 and an inlet-manifold portion 60 of the duct wall outer surface 42 taken together define the inlet manifold 38. That is, the duct wall 24 serves both as a structural part of the duct 22 and also as one side of the inlet manifold 38, thereby saving weight. This integral manifold/duct construction also has other important advantages. It employs the elongated nonplanar inlet sheet 56 as an integral rib (a circumferential rib in the embodiments of FIGS. 1-4) to stiffen the duct 22. It positions the inlet manifold 38 closely to the duct 22, so that the reduced profile overall envelope size of the heat exchanger system 20 is as small as possible. The integral manifold/duct construction uses the length of the inlet manifold 38 that is formed in part by the inlet manifold portion 60 of the duct wall outer surface 42 to serve as a pre-heat exchanger surface with the cooling air 26 flowing within the duct 22 to begin the cooling of the hot air that flows within the inlet manifold 38. Not only does this pre-cooling improve the efficiency and allow the heat exchanger 32 to be made smaller in size and lighter in weight, but it also brings the hot air flowing in the inlet manifold 38 to a temperature closer to that of the duct wall outer surface 42 at the point where it passes into the heat exchanger 32. Consequently the thermal differential is smaller and the differential thermal stresses and strains at this location are smaller than would be experienced for alternative approaches.

A heat exchanger inlet opening 64 extends through the duct wall 24 between the interior of the inlet manifold 38 and the interior of the heat exchanger 32. The heat exchanger inlet opening 64 allows the hot air input 28 to flow from the inlet manifold 38 into the heat exchanger 32.

The outlet manifold 40 is constructed in a similar manner and the prior description of the inlet manifold 38 is incorporated. The heat exchanger outlet manifold 40 is at an outlet location (different from the inlet location) along the duct wall 24. The heat exchanger outlet manifold 40 includes an elongated non planar outlet sheet 66 of material having two outlet-manifold side margins 68. The elongated non planar outlet sheet 66 is typically made of the same material and construction as the elongated nonplanar inlet sheet 56 but, as noted previously, the construction and material may change for later manifolds in the event that there are multiple heat exchangers.

Each outlet-manifold side margin 68 is joined to the duct wall outer surface 42 by an outlet-manifold side-margin joint 72 that extends the length of each side of the outlet manifold 40. Because the duct wall outer surface 42 is generally planar when viewed in cross section as in FIGS. 3-4, the outlet manifold 40 is typically noncircular in cross section. In FIGS. 3-4 the inlet manifold 38 and the outlet manifold 40 have been illustrated as having substantially the same cross sectional shapes and sizes, but that need not be the case. The outlet-manifold side-margin joint 72 between the outlet-manifold side margin 68 and the duct wall outer surface 42 is selected to be any operable approach that is appropriate for the materials of construction and for the service temperature, as discussed above for the inlet-manifold side-margin joint 62.

The elongated nonplanar outlet sheet 66 and an outlet-manifold portion 70 of the duct wall outer surface 42 taken together define the outlet manifold 40. That is, the duct wall 24 serves both as a structural part of the duct 22 and also as one side of the outlet manifold 40, thereby saving weight. This integral manifold/duct construction also has the other important structural and thermal advantages discussed above for the inlet manifold 38.

A heat exchanger outlet opening 74 extends through the duct wall 24 between the interior of the heat exchanger 32 and the outlet manifold 40 and the interior of the heat exchanger 32. The heat exchanger outlet opening 74 allows the air leaving the heat exchanger 32 to flow into the outlet manifold 40.

The orientation of the manifolds 38, 40 and positioning of the heat exchanger(s) relative to the duct 22 is selected according to the thermodynamics of the required cooling performance. The duct 22 has a fluid-flow direction therethrough corresponding in the illustrated case to the flow direction of the cooling air 26. The manifolds 38, 40 are shown with their directions of elongation perpendicular to the flow direction of the cooling air 26, resulting in a generally cross-flow heat exchanger. That is, in the illustrated preferred configuration the directions of elongation of the manifolds 38, 40 are each circumferential around the duct wall 24, while the cooling air 26 flows through the interior of the duct 22. This flow direction of the air being cooled is further influenced by the interior design of the internal baffles 54 of the heat exchanger 32. In other designs the directions of elongation of the manifolds 38, 40 could be parallel to the direction of flow of the cooling air 26 (i.e., parallel to the axis of the duct 22), so that the flow of air in the manifolds 38, 40 could be parallel flow or counter flow, depending upon the positioning of the hot air input 28 and the cool air output 30. The manifolds 38, 40 could also be made nonparallel and have other variations in routing of the air being cooled, thereby affording great flexibility in thermodynamic design for the heat exchanger system 20.

FIGS. 3 and 4 illustrate two approaches for the construction of the inlet manifold 38 and the outlet manifold 40. In the approach of FIG. 3, the elongated inlet nonplanar sheet 56 and the elongated outlet nonplanar sheet 66 are different sheets of material. As a result, the inlet-manifold side margin 58 is at a side margin 76 of the nonplanar inlet sheet 56 of material, and the outlet-manifold side margin 68 is at a side margin 78 of the nonplanar outlet sheet 66 of material. In the approach of FIG. 4, the elongated inlet planar sheet 56 and the elongated outlet planar sheet 66 are the same sheet of material, formed into the appropriate shape to define the two manifolds 38 and 40. In this case, the nonplanar inlet sheet of material 56 extends beyond the inlet-manifold side margin 58, and the nonplanar outlet sheet 66 of material extends beyond the outlet-manifold side margin 68. The approach of FIG. 3 reduces the weight slightly, but the approach of FIG. 4 increases the structural rigidity of the duct 22.

Figure 5:
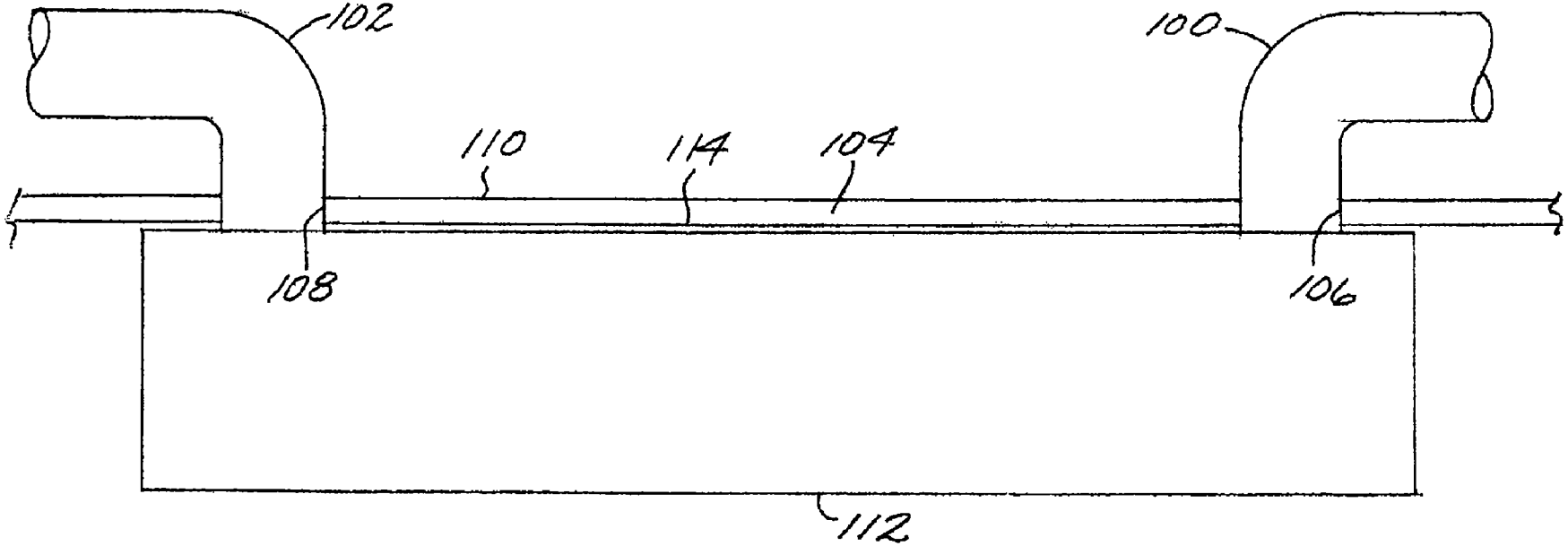
FIG. 5 is a sectional view of an approach that is not within the scope of the present invention.

The present approach is to be contrasted with an alternative approach, illustrated in FIG. 5, which does not fall within the scope of the present invention. In the approach of FIG. 5, the manifolds 100 and 102 are formed of freestanding, distinct pipes that are affixed to the duct wall 104 at the respective inlet 106 and outlet 108. A duct wall outer surface 110 does not define a portion of the walls of the manifolds 100 and 102. Also in this structure, the heat exchanger 112 is produced as a closed box (except for openings for the inlet 106 and the outlet 108). A duct wall inner surface 114 does not form a portion of the wall of the heat exchanger 112. This configuration does not afford the advantages discussed earlier for the present approach.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A heat exchanger system comprising a duct that is substantially cylindrical along a length thereof and having a duct wall with a duct wall outer surface and a duct wall inner surface;

a heat exchanger partial shell joined to the duct wall inner surface, so that the heat exchanger partial shell and a shell portion of the duct wall inner surface constitute a heat exchanger;

a heat exchanger inlet manifold at an inlet location along the duct wall and comprising an elongated nonplanar inlet sheet of material defining a portion of the inlet manifold, wherein the inlet sheet of material is joined to the duct wall outer surface, so that the elongated nonplanar inlet sheet and an inlet-manifold portion of the duct wall outer surface define the inlet manifold;

a heat exchanger inlet opening extending through the duct wall between the inlet manifold and the heat exchanger;

a heat exchanger outlet manifold at an outlet location along the duct wall and comprising an elongated nonplanar outlet sheet of material defining a portion of the outlet manifold, wherein the outlet sheet of material is joined to the duct wall outer surface, so that the elongated nonplanar outlet sheet and an outlet-manifold portion of the duct wall outer surface define the outlet manifold; and a heat exchanger outlet opening extending through the duct wall between the outlet manifold and the heat exchanger, wherein the heat exchanger is positioned to extend circumferentially with respect to the duct.

2. The heat exchanger system of claim 1, wherein the nonplanar inlet sheet of material has two inlet-manifold side margins, and each inlet-manifold side margin is joined to the duct wall outer surface, and the nonplanar outlet sheet of material has two outlet-manifold side margins, and each outlet-manifold side margin is joined to the duct wall outer surface.

3. The heat exchanger system of claim 1, wherein the nonplanar inlet sheet of material and the nonplanar outlet sheet of material are the same sheet of material.

4. The heat exchanger system of claim 1, wherein the duct is a gas flow duct.

5. The heat exchanger system of claim 1, wherein the duct is a part of a gas turbine engine.

6. The heat exchanger system of claim 1, wherein the duct is substantially cylindrical in shape at each location along its length.

7. The heat exchanger system of claim 1, wherein the duct has a fluid-flow direction therethrough, and wherein a direction of elongation of the inlet manifold is perpendicular to the fluid-flow direction.

8. The heat exchanger system of claim 1, wherein the duct has a fluid-flow direction therethrough, and wherein a direction of elongation of the outlet manifold is perpendicular to the fluid-flow direction.

9. The heat exchanger system of claim 1, wherein the inlet sheet of material is made of a metal, and wherein the inlet sheet of material is welded to the duct wall outer surface.

10. The heat exchanger system of claim 1, wherein the outlet sheet of material is made of a metal, and wherein the outlet sheet of material is welded to the duct wall outer surface.

11. The heat exchanger system of claim 1, wherein an inlet-manifold side margin is at a side margin of the nonplanar inlet sheet of material, and an outlet-manifold side margin is at a side margin of the nonplanar outlet sheet of material.

12. The heat exchanger system of claim 1, wherein a nonplanar inlet sheet of material extends beyond the inlet-manifold side margin, and a nonplanar outlet sheet of material extends beyond the outlet-manifold side margin.

13. The heat exchanger system of claim 1, wherein the heat exchanger partial shell is joined to the duct wall inner surface with a plurality of mechanical fasteners.

14. The heat exchanger system of claim 1, wherein the heat exchanger partial shell comprises an internal baffle.

15. A heat exchanger system comprising a gas turbine engine comprising a substantially cylindrical gas-flow duct having a duct wall with a duct wall outer surface and a duct wall inner surface;

a heat exchanger partial shell joined to the duct wall inner surface, so that the heat exchanger partial shell and a shell portion of the duct wall inner surface constitute a heat exchanger, wherein the heat exchanger is joined to the duct wall inner surface with a plurality of mechanical fasteners;

a heat exchanger inlet manifold at an inlet location along the duct wall and comprising an elongated nonplanar inlet sheet of material having two inlet-manifold side margins, wherein each inlet-manifold side margin is joined to the duct wall outer surface, so that the elongated nonplanar inlet sheet and an inlet-manifold portion of the duct wall outer surface define the inlet manifold, wherein the inlet sheet of material is made of a metal, and wherein the inlet sheet of material is welded to the duct wall outer surface;

a heat exchanger inlet opening extending through the duct wall between the inlet manifold and the heat exchanger;

a heat exchanger outlet manifold at an outlet location along the duct wall and comprising an elongated nonplanar outlet sheet of material having two outlet-manifold side margins, wherein each outlet-manifold side margin is joined to the duct wall outer surface, so that the elongated nonplanar outlet sheet and an outlet-manifold portion of the duct wall outer surface define the outlet manifold, wherein the outlet sheet of material is made of a metal, and wherein the outlet sheet of material is welded to the duct wall outer surface; and a heat exchanger outlet opening extending through the duct wall between the outlet manifold and the heat exchanger;

wherein the heat exchanger is positioned to extend circumferentially with respect to the gas-flow duct.

16. The heat exchanger system of claim 15, wherein the duct has a fluid-flow direction therethrough, and wherein a direction of elongation of the inlet manifold is perpendicular to the fluid-flow direction.

17. The heat exchanger system of claim 15, wherein the duct has a fluid-flow direction therethrough, and wherein a direction of elongation of the outlet manifold is perpendicular to the fluid-flow direction.

18. The heat exchanger system of claim 15, wherein the heat exchanger partial shell comprises an internal baffle.

19. A heat exchanger system comprising a substantially cylindrical duct having a duct wall with a duct wall outer surface and a duct wall inner surface;

a heat exchanger partial shell hermetically joined to the duct wall inner surface, so that the heat exchanger partial shell and a shell portion of the duct wall inner surface constitute a heat exchanger;

a heat exchanger inlet manifold defined by a nonplanar inlet sheet of material hermetically joined to the duct wall outer surface, and an inlet-manifold portion of the duct wall outer surface;

a heat exchanger inlet opening extending through the duct wall between the inlet manifold and the heat exchanger;

a heat exchanger outlet manifold defined by a nonplanar outlet sheet of material hermetically joined to the duct wall outer surface, and an outlet-manifold portion of the duct wall outer surface; and a heat exchanger outlet opening extending through the duct wall between the outlet manifold and the heat exchanger, wherein at least one of the nonplanar inlet sheet or the nonplanar outlet sheet defines a circumferential rib to stiffen the duct; and wherein the heat exchanger is positioned to extend circumferentially with respect to the duct.

20. The heat exchanger system of claim 19, wherein the nonplanar inlet sheet of material and the nonplanar outlet sheet of material are the same sheet of material.

21. The heat exchanger system of claim 19, wherein the nonplanar inlet sheet of material and the nonplanar outlet sheet of material are different sheets of material.

* * * * *

UNITED STATES PATENT AND TRADEMARK OFFICE

CERTIFICATE OF CORRECTION

PATENT NO. : 7,784,528 B2
APPLICATION NO. : 11/616587
DATED : August 31, 2010
INVENTOR(S) : Nathan Ottow et al.

It is certified that error appears in the above-identified patent and that said Letters Patent is hereby corrected as shown below:

In The Specification

In Column 1, Line 11, before BACKGROUND OF THE INVENTION insert

--STATEMENT REGARDING FEDERALLY SPONSORED RESEARCH & DEVELOPMENT
The US Government may have certain rights in this invention pursuant to Contract No. N00019-96-C-0176 awarded by the US Department of the Air Force.--

Signed and Sealed this
Tenth Day of May, 2016

Michelle K. Lee

Michelle K. Lee
*Director of the United States Patent and Trademark Office*